US009357839B1

(12) United States Patent
Liu et al.

(10) Patent No.: US 9,357,839 B1
(45) Date of Patent: Jun. 7, 2016

(54) FOLDING AND UNFOLDING STRUCTURE FOR HANGING TABLE

(71) Applicant: KEYSHEEN INDUSTRY(SHANGHAI) CO., LTD., Shanghai (CN)

(72) Inventors: Lausan Chung-Hsin Liu, Shanghai (CN); Shopo Hsin Tsu Liu, Shanghai (CN); Fibro Tsu Kun Liu, Shanghai (CN)

(73) Assignee: KEYSHEEN INDUSTRY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 14/732,163

(22) Filed: Jun. 5, 2015

(51) Int. Cl.
*A47B 5/02* (2006.01)
*A47B 5/04* (2006.01)

(52) U.S. Cl.
CPC .... *A47B 5/04* (2013.01); *A47B 5/02* (2013.01)

(58) Field of Classification Search
CPC ..... A47B 5/02; A47B 5/04; A47B 5/00; A47B 3/00; A47B 3/002; A47B 2005/00
USPC ..... 108/42, 47
See application file for complete search history.

(56) References Cited

U.S. PATENT DOCUMENTS 1,571,753 A * 2/1926 Christian ..... A47B 31/06 108/47
2,483,899 A * 10/1949 Grasso ..... A47B 5/04 108/134
3,113,533 A * 12/1963 Snow ..... A47B 5/04 108/134
3,650,355 A * 3/1972 Boswell ..... F16N 17/06 184/59
4,357,881 A * 11/1982 De Long ..... A47B 23/02 108/135
6,343,834 B1 * 2/2002 Wurmlinger ..... A47C 9/06 108/134
6,474,244 B1 * 11/2002 Karpinski ..... E04H 4/14 108/42
7,464,652 B2 * 12/2008 Hauck ..... A47B 5/04 108/42
7,739,964 B2 * 6/2010 Hatton ..... B63B 25/002 108/135
7,966,948 B1 * 6/2011 Galietti ..... A47B 83/04 108/134
8,267,017 B1 * 9/2012 Michael ..... A47B 5/04 108/134
8,607,777 B2 * 12/2013 Ducate, Jr. ..... A47J 37/0786 126/1 R
8,857,347 B1 * 10/2014 Liu ..... A47B 5/02 108/47
2007/0101908 A1 * 5/2007 Makita ..... A47B 5/02 108/47

* cited by examiner

*Primary Examiner* — Daniel Rohrhoff
(74) *Attorney, Agent, or Firm* — Muncy, Geissler, Olds & Lowe, P.C.

(57) ABSTRACT

A folding and unfolding structure for a hanging table which includes a support rack, a table panel and a suspension fastening structure with the a loading rib located on a back side of the table panel, pivotally bridged the loading rib and the support rack, comprising a first swivel rack hinged on the loading rib and a second swivel rack hinged on a lower edge of the support rack. The first swivel rack has an anchor and loading fork latchable on the second swivel rack and a movable coupling pin pivotally coupled on the second swivel rack. The second swivel rack has a housing space to accommodate swivel movement of folding or unfolding of the first swivel rack and a guide slot for sliding of the movable coupling pin). Through the folding and unfolding structure the table panel can be quickly unfolded and folded to improve usability.

16 Claims, 10 Drawing Sheets

FOLDING AND UNFOLDING STRUCTURE FOR HANGING TABLE

FIELD OF THE INVENTION

The present invention relates to a hanging table and particularly to a folding and unfolding structure for hanging tables.

BACKGROUND OF THE INVENTION

Many people have paid much attention to leisure life quality and household activities nowadays. Many community gardens, backyards, public parks or house balconies often serve as people's gathering and chatting venues. To provide resting or meet visual art requirement, many of those locations have fixed table tops attached to balustrades to hold potted landscapes, leisure parasols, lamp sets, tea sets or the like.

In order to provide a table top for hanging on handrail, U.S. Pat. No. 8,857,347 discloses a "Foldable Hanging Table" which can be hung on a construction structure equipped with a loading top edge. The foldable hanging table includes a table panel, a suspension structure and a folding assembly. The suspension structure includes a support rack hinged on the table panel and a suspension arm straddled the construction structure to lean on the loading top edge. The folding assembly includes a swivel frame hinged on the table panel and a driven member hinged respectively on the support rack and the swivel frame. The driven member includes an anchor portion to confine swivel of the swivel frame against the table panel and a drive portion connected to the anchor portion and operable to release the anchor portion from the swivel frame so that the swivel frame can be swiveled to facilitate folding and enhance supporting force of the table panel. The folding or unfolding structure of the hanging table in the aforesaid technique is quite complex that makes operation more difficult and usability lower. Moreover, the existing technique and design also do not provide a stabilizing structure when the table panel is at the unfolding state. Hence the unfolding table panel could be folded automatically in the event of moving up or down caused by incidental bumping of users. That could cause serious problems such as falling and damage of the goods placed on the table panel.

SUMMARY OF THE INVENTION

The primary object of the present invention is to provide improved usability and structural stability of products.

To achieve the foregoing object the present invention provides a folding and unfolding structure for a hanging table which includes a support rack, a table panel which is hinged on the support rack and has a loading rib located on a back side and a suspension fastening structure located at an upper end of the support rack to be anchored on a building structural body. The support rack has a suspension arm at the upper end that is connected to the suspension fastening structure and hung on and fastened to a loading top edge of the building structural body. The hanging table also includes at least one folding and unfolding structure pivotally bridged the loading rib and the support rack. The folding and unfolding structure includes a first swivel rack hinged on the loading rib and a second swivel rack hinged on a lower edge of the support rack. The first swivel rack has an anchor and loading fork latchable on the second swivel rack and a movable coupling pin pivotally coupled on the second swivel rack. The second swivel rack has a housing space to accommodate swivel movements of folding and unfolding of the first swivel rack and a guide slot for sliding of the movable coupling pin.

In one embodiment of the invention the movable coupling pin has a pin knob located on at least one end thereof, and the second swivel rack has a swivel latch member hinged thereon that has a latch notch latchable with the pin knob to provide anchoring thereof.

In another embodiment the second swivel rack includes a load receiving member latchable with the first swivel rack and the anchor and loading fork for anchoring thereof.

In yet another embodiment the table panel includes a hinge end which has at least two pintles hinged on the support rack.

In yet another embodiment the first swivel rack has a first elastic pad to provide impact buffer between the first swivel rack and the back side of the table panel in a folding state.

In yet another embodiment the second swivel rack has a second elastic pad to provide impact buffer between the second swivel rack and the first swivel rack in the folding state.

The folding and unfolding structure for a hanging table of the invention thus formed, compared with the conventional techniques, provides many advantages, notably:

1. The table panel can be unfolded easier and quicker when in use, and folded downward rapidly when not in use.

2. Through the swivel latch member latched on the pin knob the folding and unfolding structure can make the unfolding table panel more secured and stable when in use.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
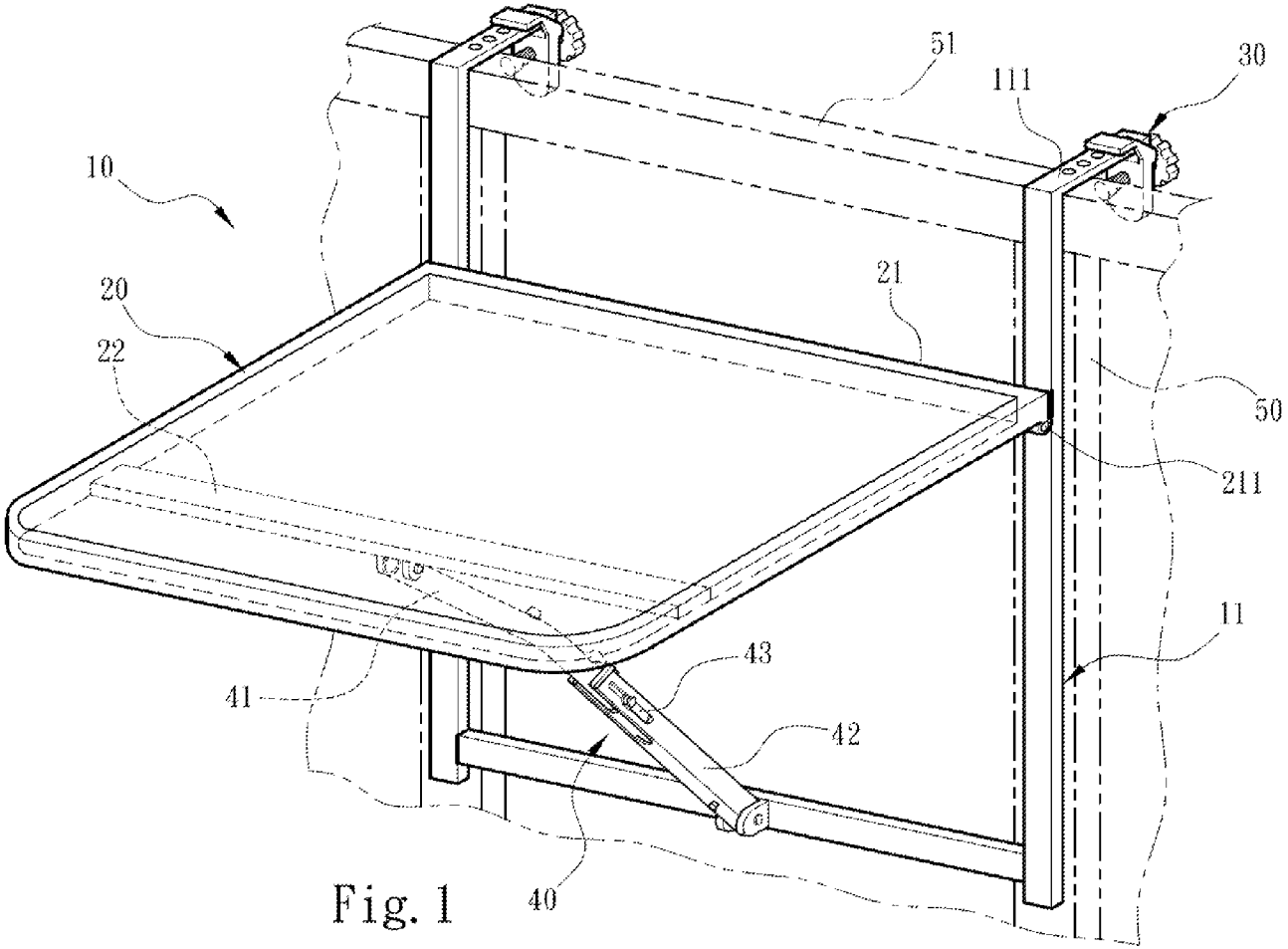
FIG. 1 is a perspective view of an embodiment of the invention at an unfolding state.
Figure 2:
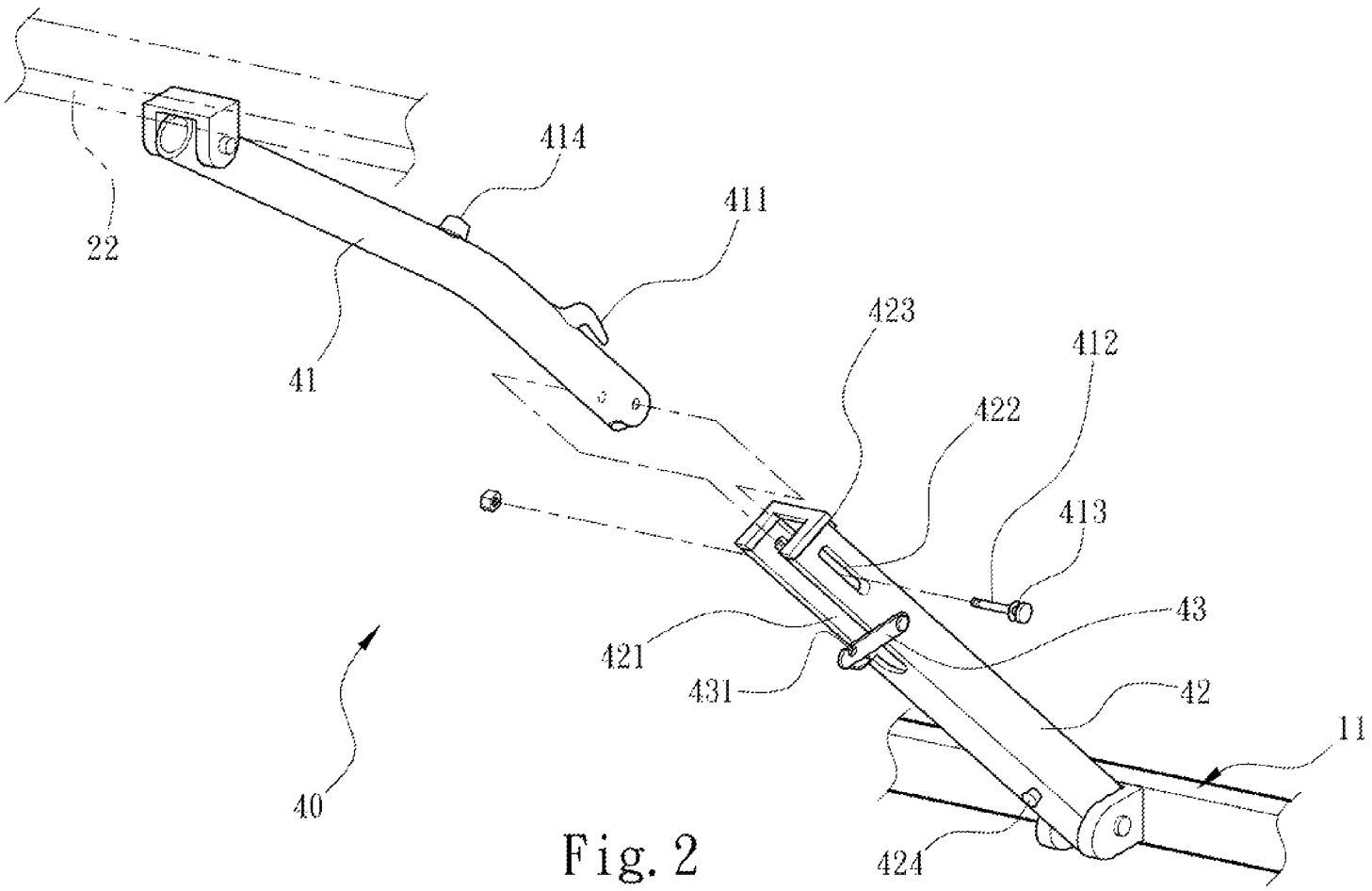
FIG. 2 is a fragmentary exploded view based on FIG. 1.
Figure 3:
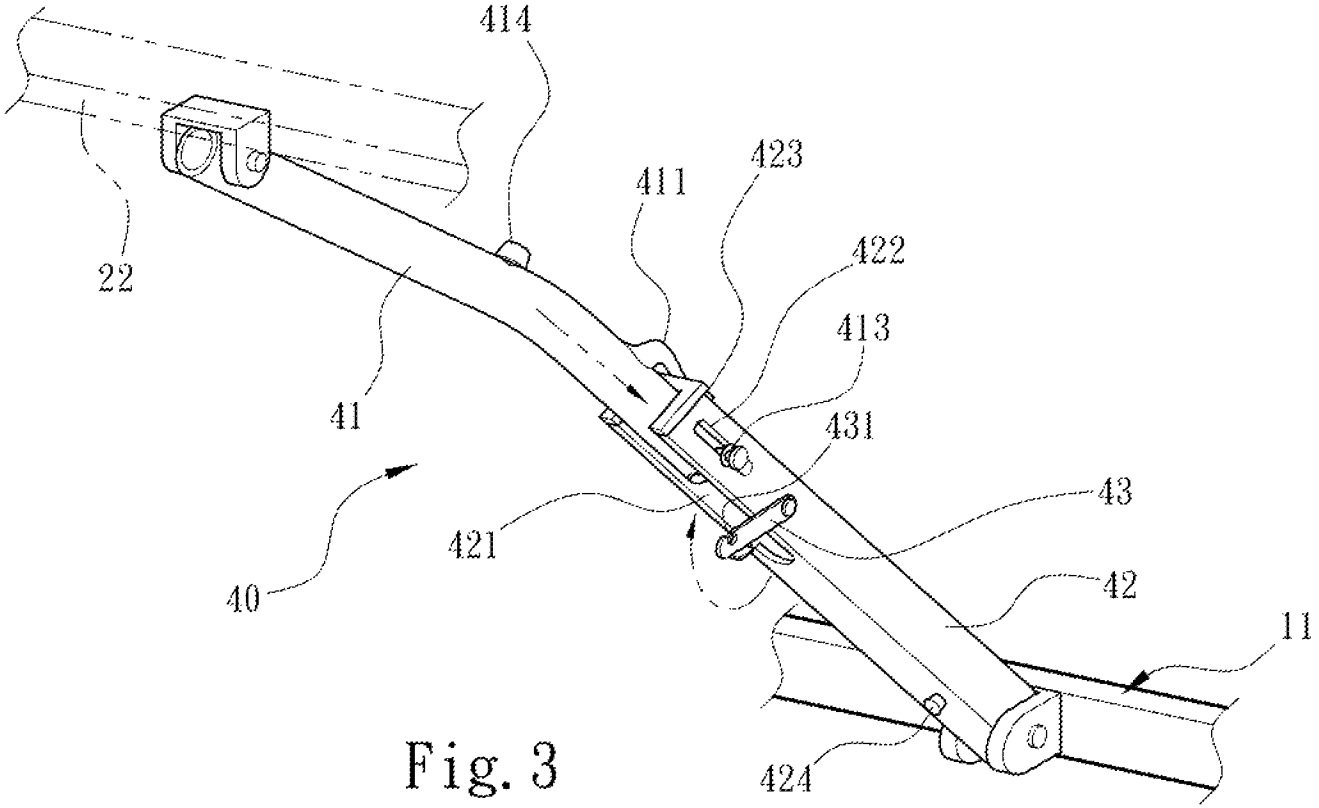
FIG. 3 is a schematic view of the folding and unfolding structure in an unfolding assembly condition based on FIG. 2.
Figure 4:
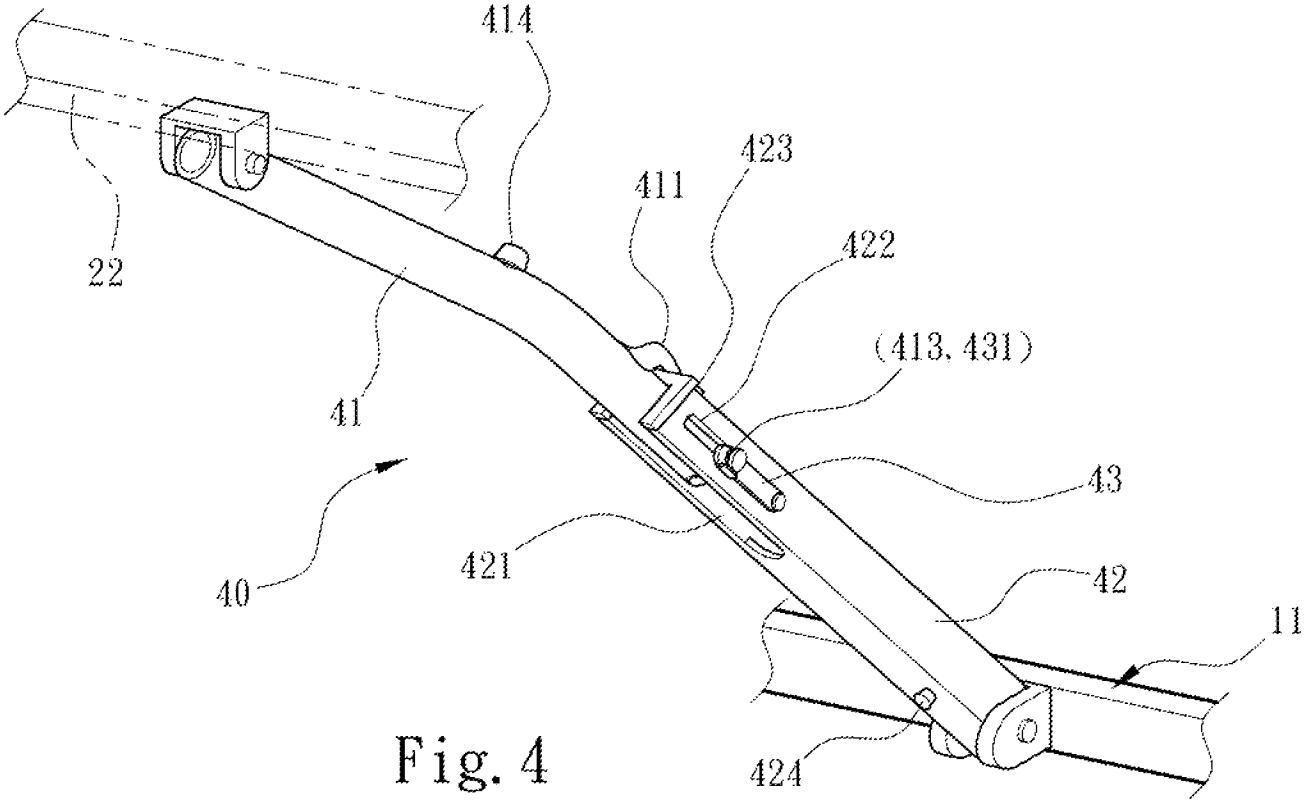
FIG. 4 is a schematic view of the swivel latch member and the pin knob in a latched condition based on FIG. 3.
Figure 5:
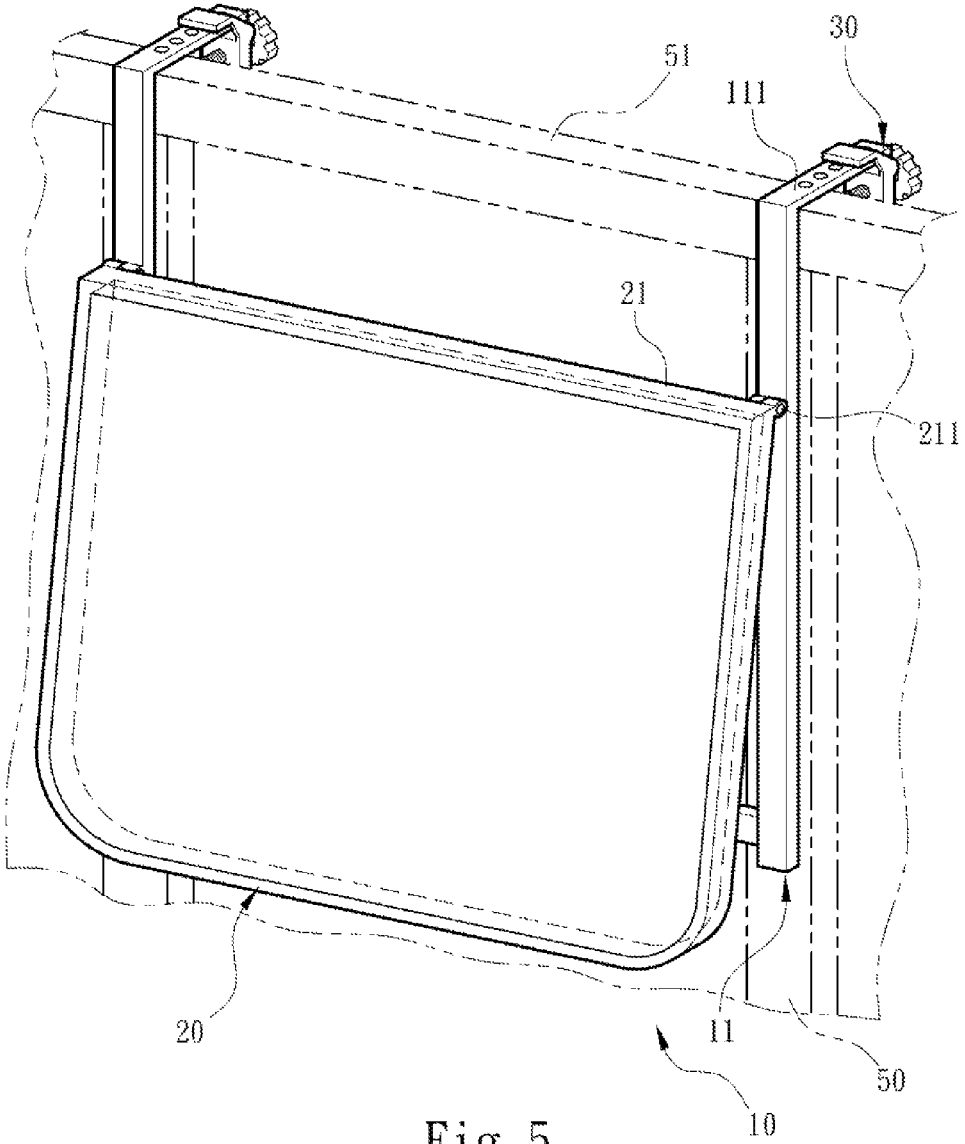
FIG. 5 is a perspective view of the invention at a folding state based on FIG. 1.

Please refer to FIGS. 1 through 5 for an embodiment of the folding and unfolding structure for a hanging table 10 of the invention. The hanging table 10 comprises a support rack 10, a table panel 20 hinged on the support rack 11 and a suspension fastening structure 30 (similar to that of the conventional techniques) located at an upper end of the support rack 11 and fastened to a building structural body 50. The support rack 11 has a suspension arm 111 at the upper end that is connected to the suspension fastening structure 30 and hung on and fastened to a loading top edge 51 of the building structural body 50. The table panel 20 has a loading rib 22 on a back side. The loading rib 22 and the support rack 11 are pivotally bridged by at least one folding and unfolding structure 40. The folding and unfolding structure 40 includes a first swivel rack 41 hinged on the loading rib 22 and a second swivel rack 42 hinged on a lower edge of the support rack 11. The first swivel rack 41 has an anchor and loading fork 411 latchable on the second swivel rack 42 and a movable coupling pin 412 pivotally coupled on the second swivel rack 42. The second swivel rack 42 has a housing space 421 to accommodate swivel movements of folding and unfolding of the first swivel rack 41 and a guide slot 422 for sliding of the movable coupling pin 412. The anchor and loading fork 411 allows the table panel 20 to be positioned proximate a horizontal position and also enables the first swivel rack 41 and the second swivel rack 42 to rapidly latch with each other and support the gravity of goods placed on the table panel 20. In this embodiment the movable coupling pin 412 has a pin knob 413 located on at least one end thereof. The second swivel rack 42 also has a swivel latch member 43 hinged thereon. The swivel latch member 43 has a latch notch 431 to latch the pin knob 413. It is to be noted that the second swivel rack 42 further has a load receiving member 423 to be latched by the first swivel rack 41 and the anchor and loading fork 411 for positioning. The load receiving member 423 has to bear forces, hence must be made of a sturdy and durable material. In addition, the table panel 20 has a hinge end 21 which has at least two pintles 211 located thereon to hinge on the support rack 11. Furthermore, the first swivel rack 41 has a first elastic pad 414 located thereon to provide impact buffer between the first swivel rack 41 and the backside of the table panel 20 during folding movement, and the second swivel rack 42 also has a second elastic pad 424 located thereon to provide impact buffer between the second swivel rack 42 and the first swivel rack 41 during folding movement.

Figure 6:
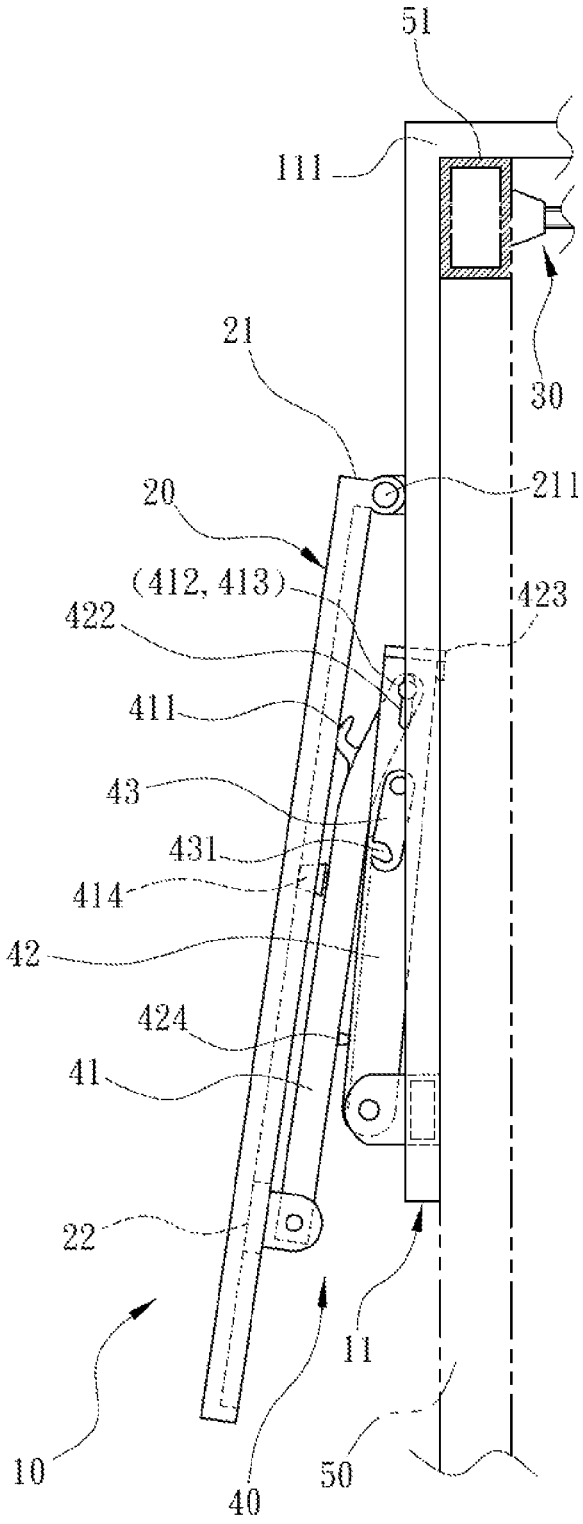
FIG. 6 is a schematic right side view based on FIG. 5.
Figure 7:
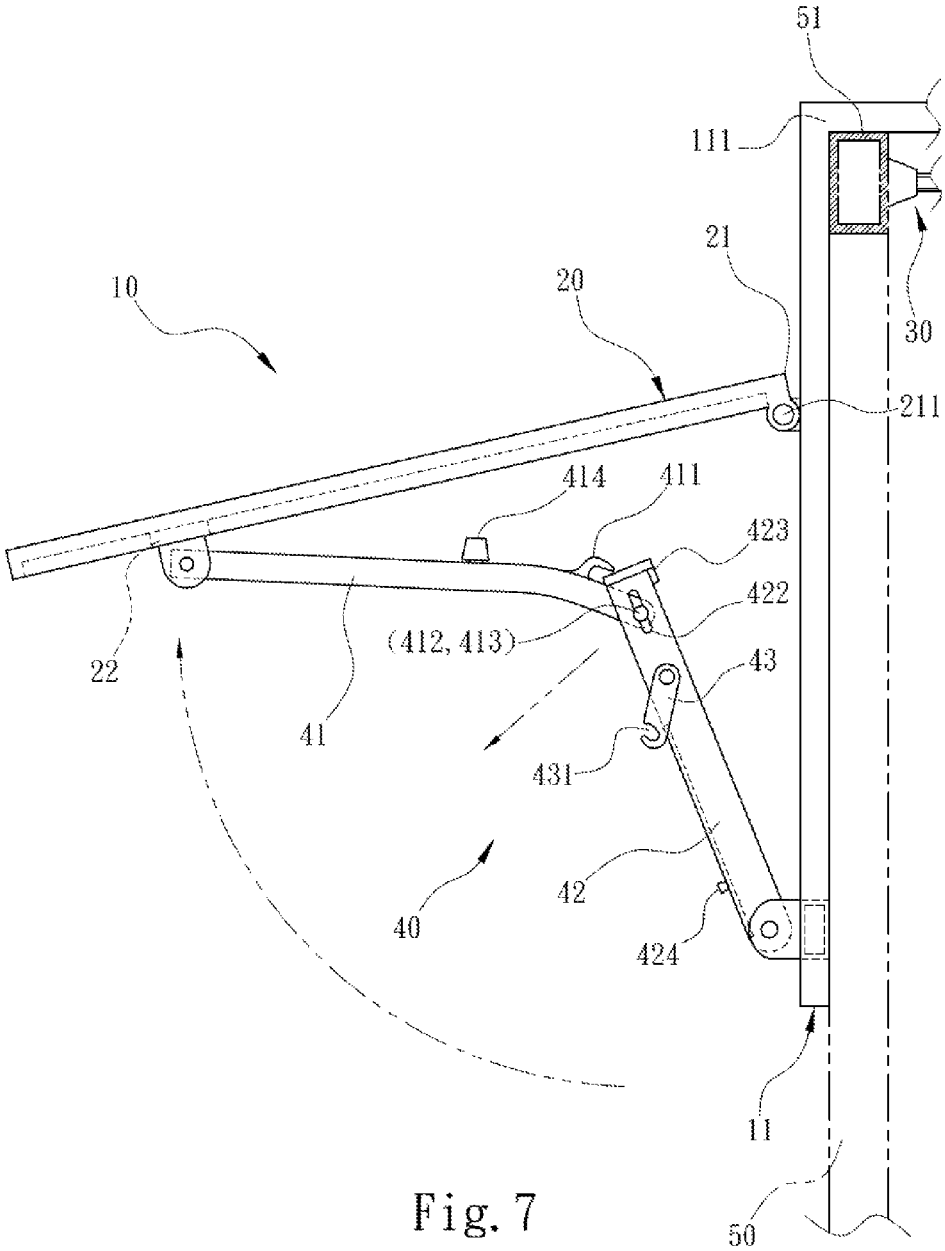
FIGS. 7 through 10 are schematic views of the table panel in consecutive unfolding conditions based on FIG. 6.
Figure 8:
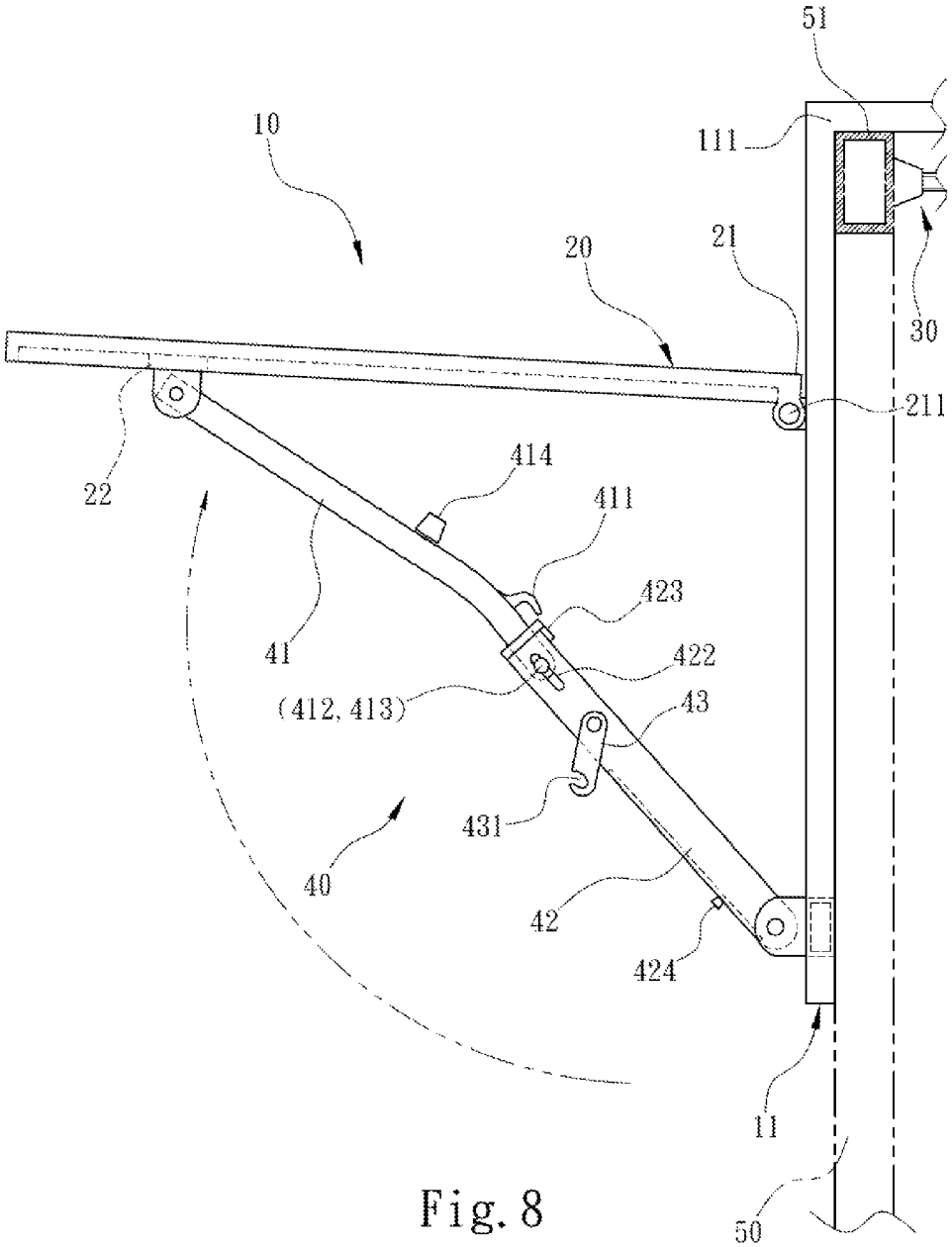
Figure 9:
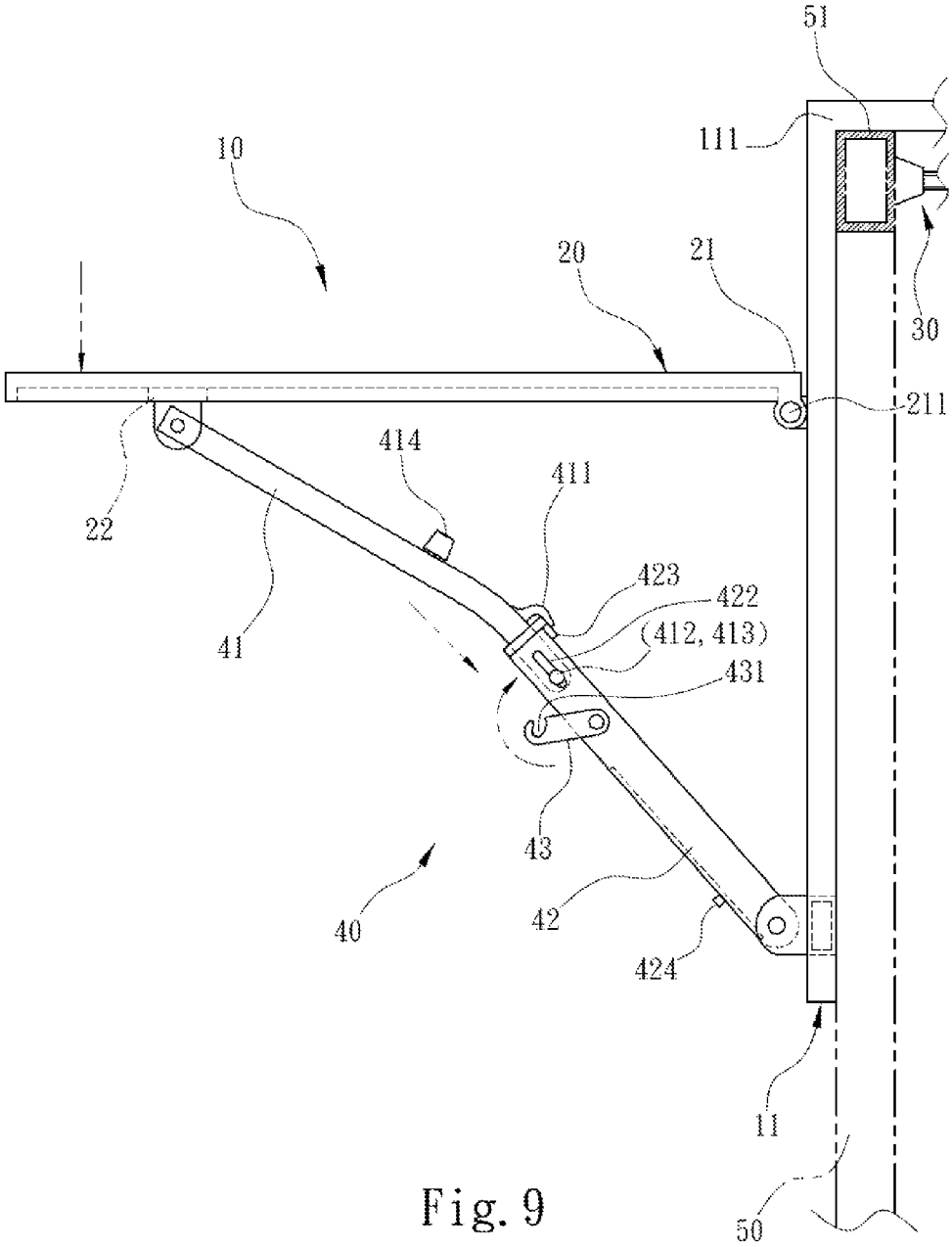
Figure 10:
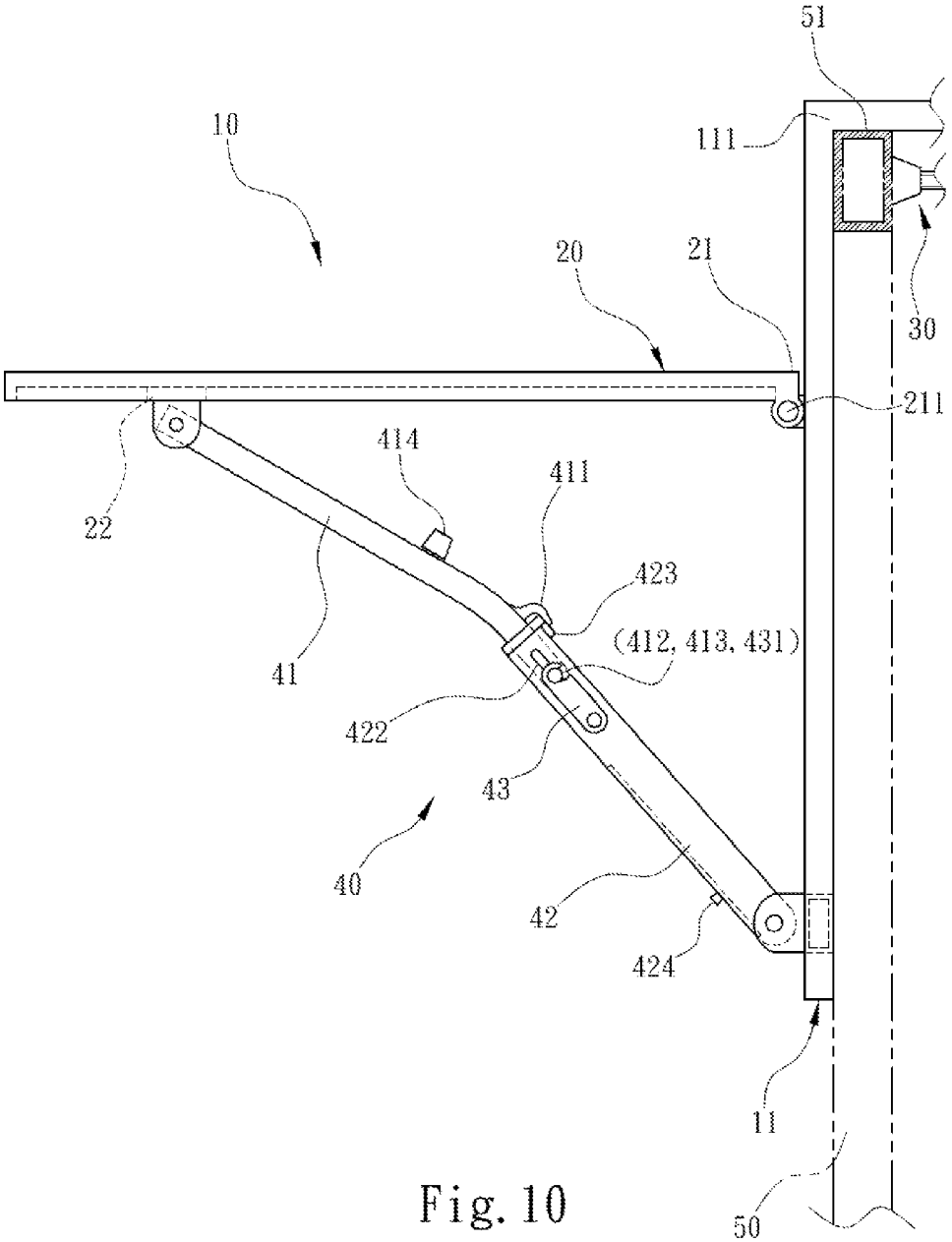

Please also refer to FIGS. 5 through 10 for the invention in use conditions. FIG. 6 illustrates the table panel 20 being moved downward at a folding state, the first elastic pad 414 of the first swivel rack 41 presses the back side of the table panel 20, while the second elastic pad 424 of the second swivel rack 42 presses the first swivel rack 41, meanwhile, the swivel latch member 43 hinged on the second swivel rack 42 does not yet latch on the pin knob 413. When the table panel 20 is raised upward in the clockwise direction as shown in FIG. 7 it can swivel against the support rack 11 about the pintles 211, consequentially the hinged junction of the first swivel rack 41 and the second swivel rack 42 is driven and moved toward a lower left corner, and the movable coupling pin 412 is sliding in the guide slot 422, while the anchor and loading fork 412 is moved above the top edge of the second swivel rack 42 as shown in FIG. 8. When the surface of the table panel 20 is swiveled over the horizontal surface and the anchor and loading fork 411 is swiveled corresponding to the load receiving member 423, the table panel 20 can be swiveled downward counterclockwise via a force in the opposite direction until the table panel 20 is proximate the horizontal position with the anchor and loading fork 411 latched downward on the load receiving member 423 for anchoring as shown in FIG. 9, then the table panel 20 is at a fully unfolding state with the pin knob 413 of the movable coupling pin 412 moved to a lower side of the guide slot 422. In order to make the unfolding table panel to be anchored in a secured manner the latch notch 431 of the swivel latch member 43 can be swiveled to latch on the pin knob 413. In the event that folding the table panel 20 is desired again, proceed the movements previously discussed in a reverse sequence. Operation principle is similar but in reverse order, hence details are omitted herein. As a result, through the folding and unfolding structure for hanging tables of the invention not only the table panel can be easily and quickly unfolded when in use, the table panel also can be folded rapidly downward after use is finished, and the table panel also can be maintained securely and steadily at the unfolding state when in use.

What is claimed is:

1. A folding and unfolding structure for a hanging table, the hanging table including:

a support rack;

a table panel which is hinged on the support rack and includes a loading rib on a back side thereof;

a suspension fastening structure located on an upper end of the support rack and fastened to a building structural body, the support rack including a suspension arm at the upper end that is connected to the suspension fastening structure and hung on and fastened to a loading top edge of the building structural body; and at least one folding and unfolding structure to pivotally bridge the loading rib and the support rack; the folding and unfolding structure comprising:

a first swivel rack which is hinged on the loading rib and includes an anchor and loading fork and a movable coupling pin; and a second swivel rack which is hinged on a lower edge of the support rack and latchable on the anchor and loading fork and pivotally coupled with the movable coupling pin, and includes a housing space to accommodate swivel movement of unfolding or folding of the first swivel rack and a guide slot for sliding of the movable coupling pin, wherein the movable coupling pin includes a pin knob on at least one end thereof, and the second swivel rack includes a swivel latch member hinged thereon that includes a latch notch latchable with the pin knob.

2. The folding and unfolding structure of claim 1, wherein the second swivel rack further includes a load receiving member to anchor the first swivel rack and latch with the anchor and loading fork.

3. The folding and unfolding structure of claim 1, wherein the second swivel rack further includes a load receiving member to anchor the first swivel rack and latch with the anchor and loading fork.

4. The folding and unfolding structure of claim 3, wherein the table panel includes a hinge end which includes at least two pintles to hinge on the support rack.

5. The folding and unfolding structure of claim 4, wherein the first swivel rack further includes a first elastic pad to provide impact buffer between the first swivel rack and the back side of the table panel at a folding state.

6. The folding and unfolding structure of claim 5, wherein the second swivel rack further includes a second elastic pad to provide impact buffer between the second swivel rack and the first swivel rack at a folding state.

7. The folding and unfolding structure of claim 4, wherein the second swivel rack further includes a second elastic pad to provide impact buffer between the second swivel rack and the first swivel rack at a folding state.

8. The folding and unfolding structure of claim 3, wherein the first swivel rack further includes a first elastic pad to provide impact buffer between the first swivel rack and the back side of the table panel at a folding state.

9. The folding and unfolding structure of claim 8, wherein the second swivel rack further includes a second elastic pad to provide impact buffer between the second swivel rack and the first swivel rack at a folding state.

10. The folding and unfolding structure of claim 3, wherein the second swivel rack further includes a second elastic pad to provide impact buffer between the second swivel rack and the first swivel rack at a folding state.

11. The folding and unfolding structure of claim 1, wherein the table panel includes a hinge end which includes at least two pintles to hinge on the support rack.

12. The folding and unfolding structure of claim 1, wherein the table panel includes a hinge end which includes at least two pintles to hinge on the support rack.

13. The folding and unfolding structure of claim 1, wherein the first swivel rack further includes a first elastic pad to provide impact buffer between the first swivel rack and the back side of the table panel at a folding state.

14. The folding and unfolding structure of claim 1, wherein the first swivel rack further includes a first elastic pad to provide impact buffer between the first swivel rack and the back side of the table panel at a folding state.

15. The folding and unfolding structure of claim 1, wherein the second swivel rack further includes a second elastic pad to provide impact buffer between the second swivel rack and the first swivel rack at a folding state.

16. The folding and unfolding structure of claim 1, wherein the second swivel rack further includes a second elastic pad to provide impact buffer between the second swivel rack and the first swivel rack at a folding state.

* * * * *